US005323676A

United States Patent [19]

Kennedy

[11] Patent Number: 5,323,676

[45] Date of Patent: Jun. 28, 1994

[54] BAR CHORD MACHINE

[76] Inventor: John L. Kennedy, 218 Ruby St., Boise, Id. 83705

[21] Appl. No.: 926,042

[22] Filed: Aug. 5, 1992

[51] Int. Cl.[5] ..... G10D 3/00

[52] U.S. Cl. ..... 84/317; 84/318

[58] Field of Search ..... 84/315, 316, 317, 318, 84/319

[56] References Cited

U.S. PATENT DOCUMENTS

| | | |
|---|---|---|
| 1,094,038 | 4/1914 | Weaver . |
| 3,837,255 | 9/1974 | Starns et al. . |
| 3,851,558 | 12/1974 | Hopkins . |
| 4,030,400 | 6/1977 | Del Castillo . |
| 4,154,134 | 5/1979 | Schreiber . |
| 4,926,732 | 5/1990 | Collins et al. . |

*Primary Examiner*—Michael L. Gellner
*Assistant Examiner*—Cassandra Spyrou
*Attorney, Agent, or Firm*—Frank J. Dykas; Craig M. Korfanta; Ken J. Pedersen

[57] ABSTRACT

The invention is a bar chord machine for stringed musical instruments with frets. The machine has a generally longitudinal frame made of two parallel spaced-apart rods with clamps for securing the frame next to and generally parallel to the neck of the stringed instrument. One rod acts as a pivot point for a plurality of lever presses which extend perpendicularly from the rod in spaced apart relationship out over the top of the fingerboard of the instrument. The other rod acts as a pivot stop for the lever presses, and as an attachment point for springs connected to the lever presses which bias them away from the fingerboard. The lever presses have a channel in their central underside for receiving a presser bar which is pivotally connected to the lever press and spring biased away from it. The presser bar has a pad on its bottom surface for pressing down uniformly on the instrument's strings near a fret. This way, when the instrument is originally tuned to an open chord, other chords may be played by simply pushing the press lever down so that it rotates and the presser bar and pad press uniformly down on the strings near a fret.

5 Claims, 7 Drawing Sheets

BAR CHORD MACHINE

BACKGROUND OF THE INVENTION

1. Technical Field.

This invention pertains generally to stringed musical instruments with frets, like guitars and banjos. More particularly, it pertains to a mechanical chord playing attachment for stringed instruments with frets. The invention enables beginners and the disabled to easily play chords on the instrument.

2. Background Art.

There have been past attempts to provide mechanical devices for fingering stringed musical instruments. One approach has been to use devices in which mechanical substitutes for fingers press individually down on individual strings in a pattern which results in notes or chords. Examples of this approach are U.S. Pat. Nos. 1,094,038 (Weaver), 3,837,255 (Starns et al ), 4,030,400 (Del Castillo) and 4,926,732 (Collins et al.). A drawback to this approach is the complexity and expense of the machines built to implement it, due to the many moving parts required.

Another approach has been to use devices in which mechanical substitutes for fingers press jointly down on several selected strings at once in a pattern which results in a chord. Examples of this approach are U.S. Pat. Nos. 3,851,558 (Hopkins), 4,154,134 (Schreiber) and 4,428,273 (Favron). A drawback to this approach is the lack of versatility of the machines built to implement it, due to the permanence of their attachment to the instrument required.

There is a need, then, in the stringed musical instrument business, for a simple and convenient machine for bar chording which may be employed at more than one fret location. Also, there is a need for a bar chord machine which may be easily used by beginners and the disabled. My bar chord machine is designed to meet this need.

DISCLOSURE OF INVENTION

My invention is a bar chording machine for stringed instruments with frets, like guitars and banjos. The machine has a generally longitudinal frame with clamps near both ends of it to attach it securely to the neck of the stringed instrument. A stiffener for the frame near its middle which attaches to the instrument neck may also be provided. The frame is made of two parallel rods which support the clamps and stiffener. The rods are in substantially vertical alignment, relative to the top surface of the instrument neck, or fingerboard, when they are clamped to the neck. The top rod, the pivot rod, acts as a pivot point for multiple lever presses which extend generally horizontally, perpendicular to the rod and out over the instrument strings and fingerboard. The lever presses are attached by springs to the bottom rod, the attachment rod, at their proximate end from the rods, and are spring biased away from the fingerboard. At their distal end from the rods, the lever presses have finger pads for receiving the player's fingers. The lever presses are slidably connected to the rods so they may be moved up and down the instrument neck to any fret position.

The lever presses themselves are finger-like extensions from the pivot rod with a channel formed in their central underside. The channel receives a pivoted presser bar which receives a presser pad on its bottom surface for pushing down against the strings. The presser bar is spring biased away from the lever press at the distal end from the pivot rod. Adjustment screws for the presser bar are provided through the top side of the lever press at each end of it so that the travel of the presser pad may be adjusted. This way, the presser pad may be adjusted to descend evenly onto all of the strings at the same time when the lever press rotates down due to the action of the player's finger on its finger pad.

Consequently, when the instrument is tuned originally to an open chord, that is, in harmony, pushing any lever press against the strings close to a fret produces another chord. Also, any set of chords may be set up prior to playing by moving the lever presses to appropriate fret positions. This way, different chords may be played by conveniently pushing the different lever presses positioned along the fingerboard which correspond to that chord.

BEST MODE FOR CARRYING OUT INVENTION

Figure 1:
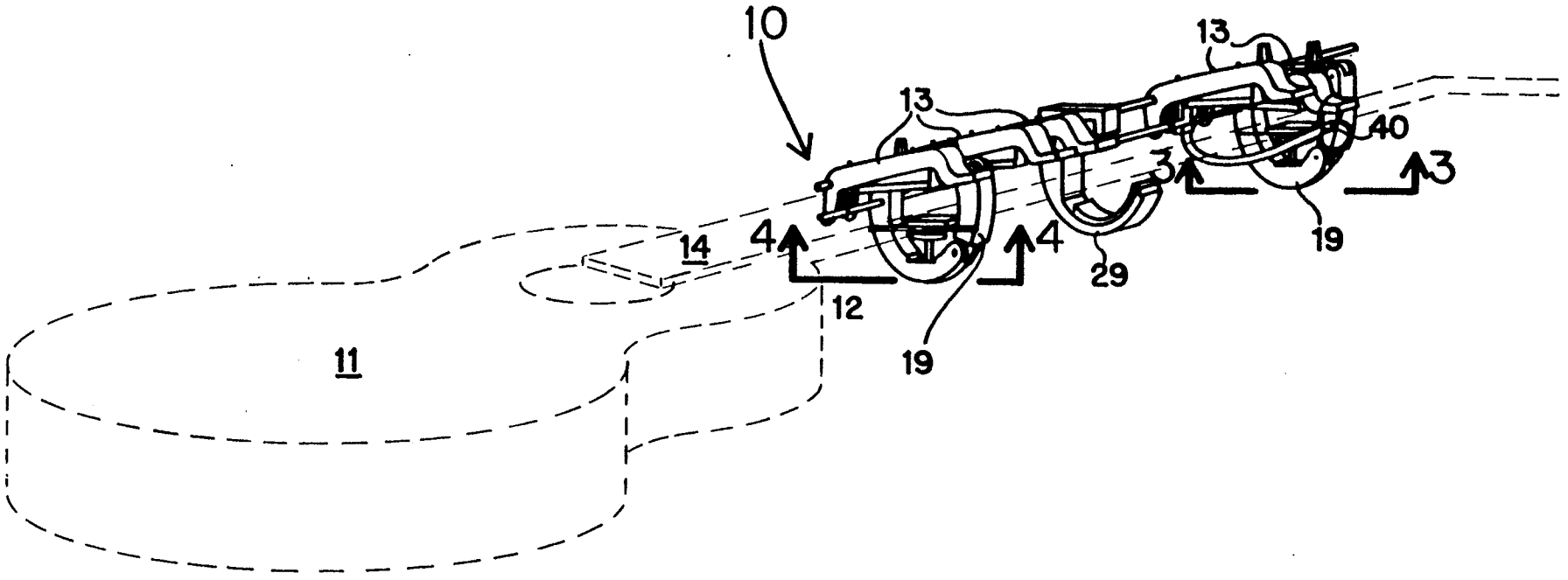
FIG. 1 is a perspective view of an embodiment of my invention attached to the neck of a guitar which is depicted in dashed lines.

Referring to the Figures, there is depicted generally an embodiment of my bar chord machine invention 10. In FIG. 1, guitar 11 has the chord machine 10 clamped to its neck 12 for a right-handed strummer. The lever presses 13 of the machine are suspended above the fingerboard 14 of the guitar.

Figure 2:
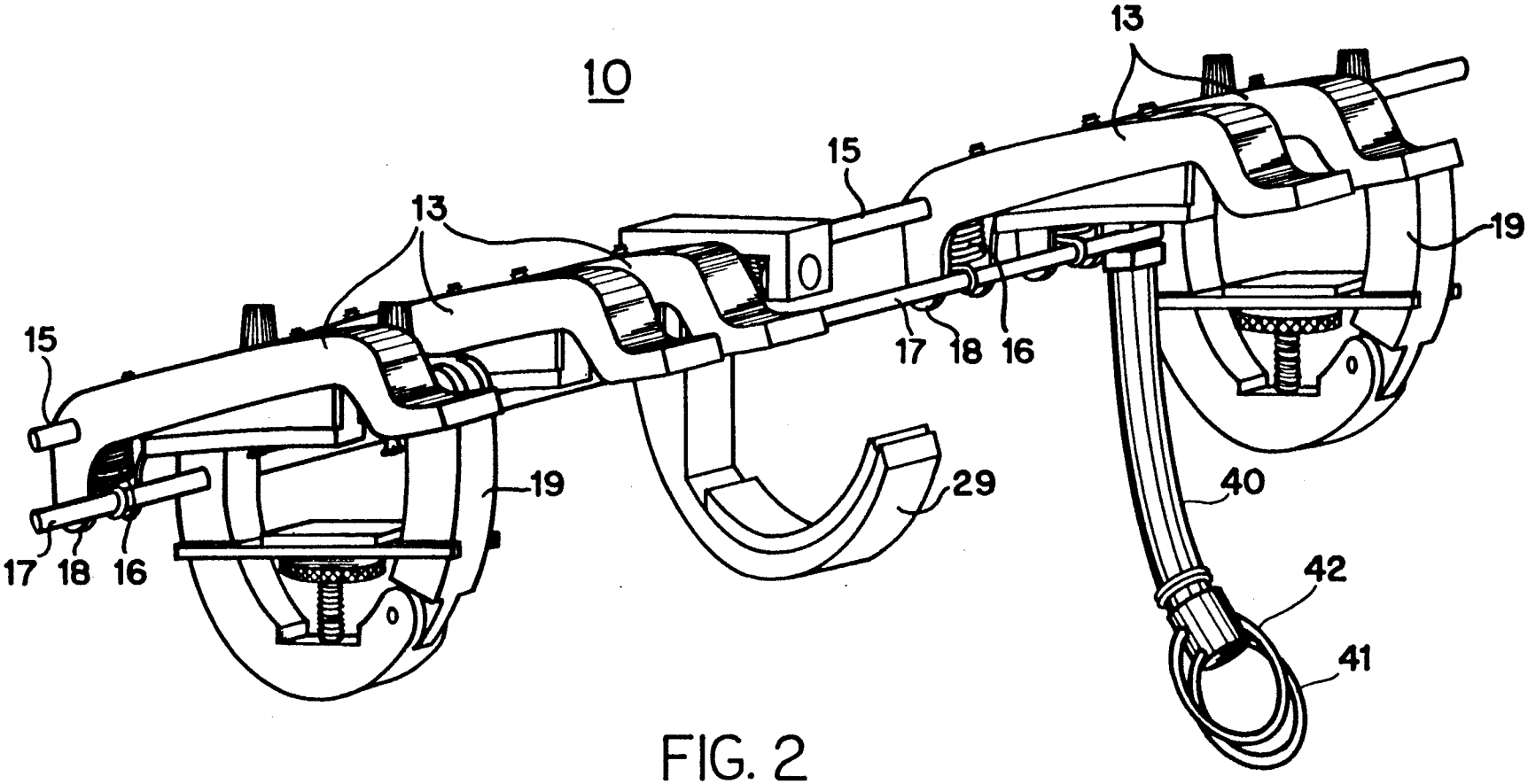
FIG. 2 is a close-up, perspective view of the embodiment in FIG. 1 without the guitar.

In FIG. 2 there is depicted in more detail lever presses 13 pivotally connected on their one end to pivot rod 15. Lever presses 13 are also connected by springs 16 to attachment rod 17. The end of lever press 13 near pivot rod 15 has pivot stop tab 18 which abuts against attachment rod 17 due to the tension in spring 16. This way, at rest the lever presses 13 extend perpendicularly from pivot rod 15 out over fingerboard 14 when the chord machine 10 is secured by clamps 19 to the neck 12 of guitar 11.

Figure 3:
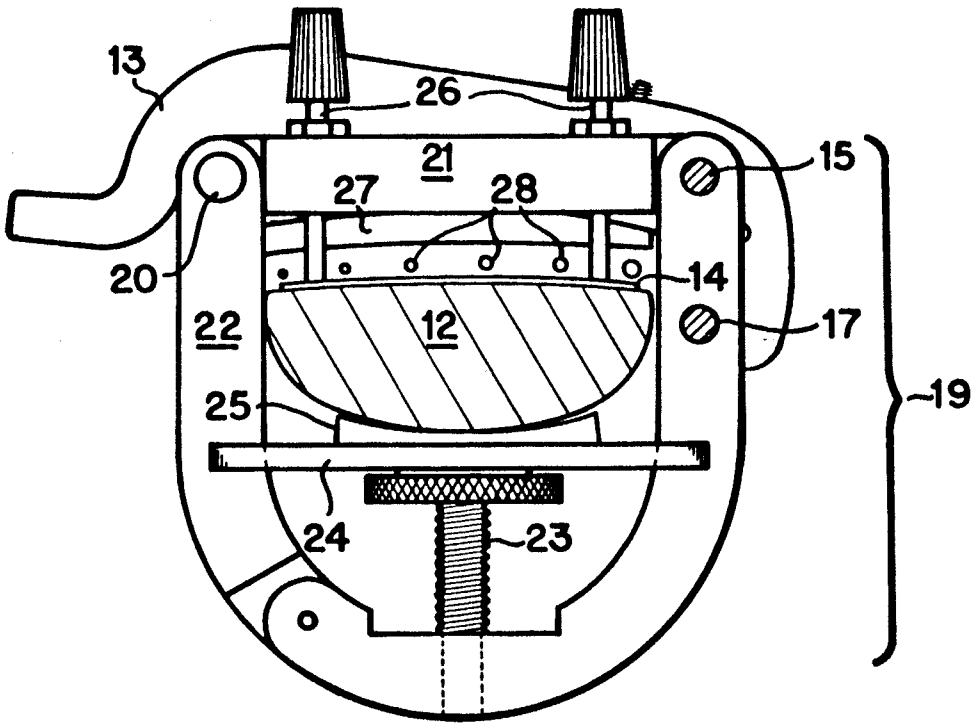
FIG. 3 is a cross-sectional, end view along the line 3—3 in FIG. 1.

Clamps 19 securely attach chord machine 10 to the guitar neck 12 so that spaced-apart, generally parallel rods 15 and 17, are maintained generally parallel to a plane defined by the side edges of guitar neck 12. As depicted in FIG. 3, clamp 19 is released by removing pin 20 and pivoting away clamp top member 21 from side member 22 to separate them. This way, clamp 19 may be easily placed around the guitar neck 12. Then, top and side members 21 and 22, respectively, are pivoted together and connected together with pin 20, and clamp 19 is attached securely to guitar neck 12 by extending screw 23 and plate 24 up against neck 12. Clamp pad 25 acts to protect neck 12 from being damaged by clamp 19. Clamp adjusters 26 which extend through clamp top member 21 onto fingerboard 14 may be used to ensure that presser pad 27 of lever press 13 is maintained a uniform distance above guitar strings 28.

Clamp 19 is attached to and supported by both pivot rod 15 and attachment rod 17. Preferably, clamp 19 is slidably connected along the rods. This way, it may be adjusted relative to the guitar neck 12 and the frets on it to adaptably fit a variety of guitars and other instruments.

Figure 6:
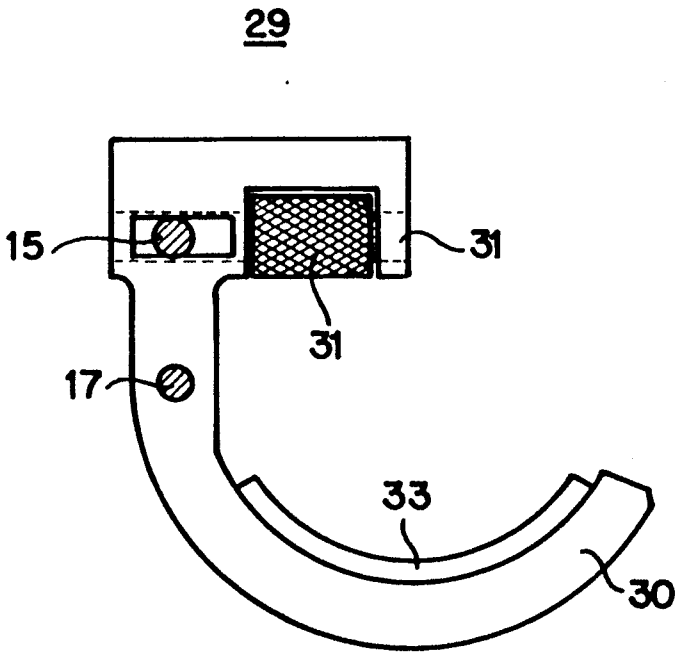
FIG. 6 is an end, detail view of an embodiment of the stiffener mechanism of my invention.

Optionally, stiffener means 29 may be provided near the midpoint of the chord machine's 10's frame. As depicted in FIG. 6, one embodiment of the stiffener 29 is a generally C-shaped member 30 attached to and supported by both pivot rod 15 and attachment rod 17. C-shaped member 30 has a threaded rod 31 near its top end which surrounds pivot rod 15, and a threaded nut 32 which moves threaded rod 31, and pivot rod 15, relative to C-shaped member 30. This way, C-shaped member 30 may be rotatably adjusted about attachment rod 17 to provide stiffening support to the frame made of rods 15 and 17. Stiffener pad 33 is provided to protect guitar neck 12 from damage by stiffener 29.

Figure 4:
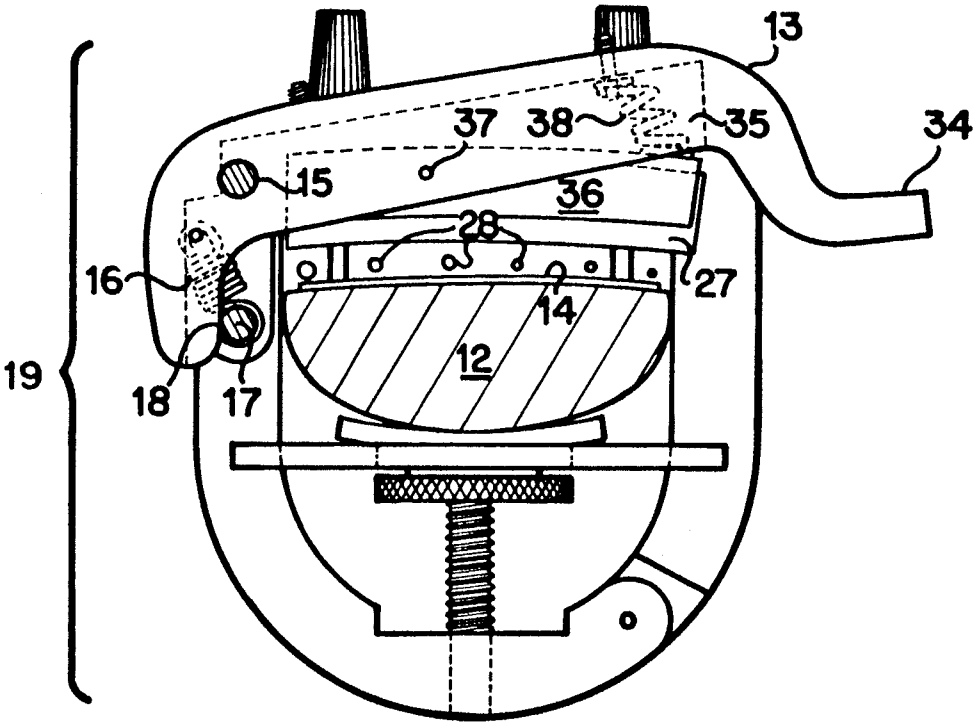
FIG. 4 is a cross-sectional, end view along the line 4—4 in FIG. 1.

As depicted in FIG. 4, lever presses 13 have an end, the proximate end to rods 15 and 17, with a pivot stop pad 18 which abuts against attachment rod 17 when the lever press 13 is at rest. The lever press 13 rotates around pivot rod 15 which passes through the lever press near its proximate end. Spring 16 attached to lever press 13 and attachment rod 17 biases the lever press 13 away from fingerboard 14. The player's pushing down on fingerpad 34 located at the distal end of lever press 13 from rods 15 and 17 causes the lever press to rotate down around pivot rod 15 in the direction of the fingerboard 14 and the instrument strings 28.

Figure 5A:
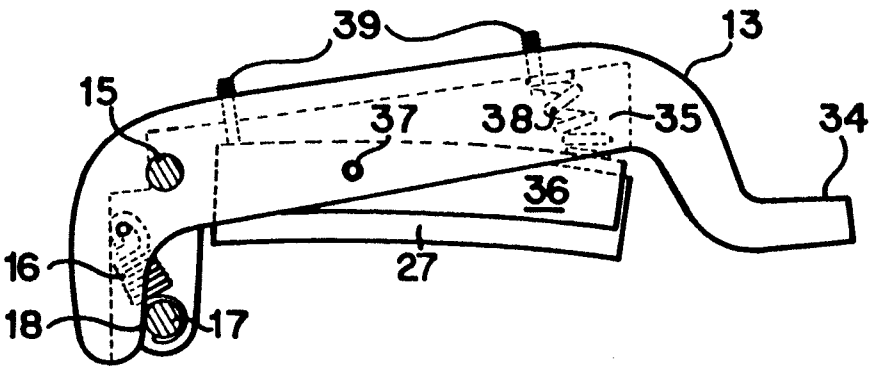
FIG. 5A is an end, partially cross-sectional detail view of an embodiment of the lever press mechanism of my invention.
Figure 5B:
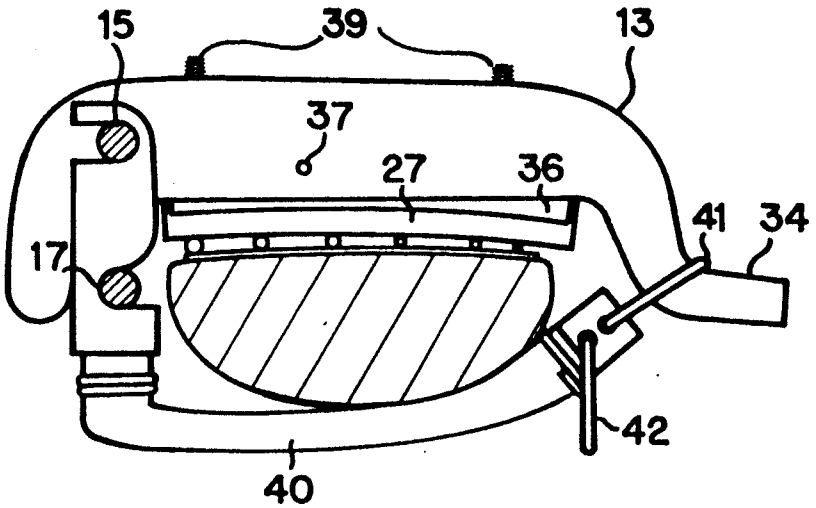
FIG. 5B is the detail view of FIG. 5A with a capotasto holding the lever press down against the strings on the fingerboard.

As depicted in FIGS. 5A and 5B, lever presses 13 have a generally longitudinal channel 35 formed in their central undersides. This channel receives presser bar 36 which is pivotally attached at pin 37 to a side surface of lever press 13. Presser bar 36 is spring biased away from lever press 13 by spring 38 near the distal end of lever press 13. This way, presser bar 36 has the proper mechanical advantage and ability to snugly push down on and evenly depress the instrument strings 28 onto fingerboard 14. A soft, elastic presser pad 27 is provided on the bottom surface of presser bar 36 to protect the instrument strings 28 from damage by presser bar 36.

Also, travel adjusters 39 are provided through the top surface of lever press 13 to adjust the orientation of pressure bar 36 and presser pad 27. One travel adjuster is located near the proximate end of lever press 13, and acts as a travel stop for the proximate end of presser bar 36. Another travel adjuster is located near the distal end of channel 35 in lever press 13, and is connected to an end of spring 38. This way, a movement of this travel adjuster acts to adjust the relative horizontal position of presser bar 36 and presser pad 27. This way, the proper level travel of presser pad 27 down onto the strings 28 is ensured.

Optionally, an elastic capotasto 40 may be provided by securing it on one end to one or both of the rods 15 and 17. On the other end of the capotasto 40 an attachment means, or hook loop 41, is provided so that capotasto 40 may be looped around the guitar neck and hooked to the finger pad of one of the lever presses to change all the bar chords on the fingerboard. Pull loop 42 aids the player in extending capotasto 40 to engage hook loop 41.

My bar chord machine may be made of conventional materials in conventional manner. I made my prototype device from a steel frame, rods, pins and nuts and five carved ABS plastic clamps and lever presses.

My frame may be made in any style or configuration, as long as it securely and pivotally supports the lever presses and holds them in spaced apart relationship out over the strings and the fingerboard. I envision the frame possibly being built without rods 15 and 17, for example, as a solid piece with grooves for accepting the lever presses 13. Or, the frame may be built into the neck of the instrument when it is manufactured.

To use my bar chord machine, the player first securely attaches it to the guitar or banjo neck 12 by clamps 19 and stiffener 29. Then, the instrument is tuned to an open chord. This means that a chord is sounded when the strings are strummed openly, that is, without any strings depressed onto the fingerboard. Then, capotasto 40 may be used to semi-permanently depress one of the lever presses onto the strings and the fingerboard, changing all the bar chords.

Then, the other lever presses are moved up and down the neck of the instrument to be located at the appropriate frets. This way, during play, different chords may be made by conveniently pushing down on the different lever presses positioned along the fingerboard which correspond to that chord.

While there is shown and described the present preferred embodiment of the invention, it is to be distinctly understood that this invention is not limited thereto but may be variously embodied to practice within the scope of the following claims.

I claim:

1. A bar chord machine for stringed musical instruments with frets which comprises:

a generally longitudinal frame comprising two parallel rods in spaced-apart relationship;

clamping means attached to and supported by both said rods, said clamping means being located near both ends of said rods;

a plurality of lever presses pivotally connected to a first one of said rods, said lever presses extending perpendicularly from said rods, and said lever presses comprising:

a generally longitudinal lever member with top, bottom and two side surfaces and a proximal end and a distal end, relative to said one of said rods, a pivot means near said proximal end, a pivot stop means at said proximal end, and a finger pad at said distal end;

a generally longitudinal channel formed in a central portion of said bottom surface of said lever member;

a generally longitudinal presser member received by said longitudinal channel and pivotally connected to one of said side surfaces of said lever member, said presser member also having top, bottom and two side surfaces and a proximal end and a distal end, relative to said proximal end and said distal end of said lever member; and a presser pad attached to the bottom surface of said presser member.

2. The bar chord machine of claim 1, wherein the clamping means is a plurality of clamps.

3. The bar chord machine of claim 1, wherein a stiffener means is also attached to and supported by both said rods.

4. The bar chord machine of claim 1, wherein the lever presses are attached to the second one of said rods by springs.

5. The bar chord machine of claim 1, comprising:

a spring having a first end and a second end; wherein the first end is connected to said distal end of said presser member and said second end is connected to the lever member, whereby, the presser member is spring biased away from the lever member at said distal end of the presser member.

* * * * *